US009221085B2

(12) United States Patent
Cates et al.

(10) Patent No.: US 9,221,085 B2
(45) Date of Patent: Dec. 29, 2015

(54) LIMITED SPACE SEPARATION AND CLEANING SYSTEM AND METHOD

(76) Inventors: Richard A. Cates, Church Point, LA (US); Craig J. Hargrave, Abbeville, LA (US)

( * ) Notice: Subject to any disclaimer, the term of this patent is extended or adjusted under 35 U.S.C. 154(b) by 887 days.

(21) Appl. No.: 13/134,684

(22) Filed: Jun. 14, 2011

(65) Prior Publication Data

US 2011/0315163 A1 Dec. 29, 2011

Related U.S. Application Data

(60) Provisional application No. 61/354,282, filed on Jun. 14, 2010.

(51) Int. Cl.
*B08B 7/04* (2006.01)
*B08B 9/093* (2006.01)

(52) U.S. Cl.
CPC ..... *B08B 9/0933* (2013.01)

(58) Field of Classification Search
None
See application file for complete search history.

(56) References Cited

U.S. PATENT DOCUMENTS

| | | | | |
|---|---|---|---|---|
| 2,303,262 | A * | 11/1942 | Dunmire | 196/46.1 |
| 4,519,848 | A | 5/1985 | Underwood | |
| 4,778,443 | A | 10/1988 | Sands et al. | |
| 4,783,272 | A | 11/1988 | Patterson | |
| 4,948,393 | A | 8/1990 | Hodson et al. | |
| 5,076,936 | A | 12/1991 | Metz | |
| 5,774,816 | A | 6/1998 | Fontenot et al. | |
| 6,162,284 | A * | 12/2000 | Mitchell et al. | 95/261 |
| 6,315,837 | B1 | 11/2001 | Barclay | |
| 2008/0047587 | A1 | 2/2008 | Ball | |

* cited by examiner

*Primary Examiner* — Eric Golightly
(74) *Attorney, Agent, or Firm* — Ted M. Anthony

(57) ABSTRACT

A cleaning and separating system is provided for cleaning tanks (such as crude oil storage tanks), and other containers or enclosures. The cleaning and separating system invention fits within a limited space having a relatively small foot-print; preferably an 8 foot tall by 8 foot wide by 10 foot deep shipping container. Generally, wash fluid is sprayed into a vessel to be cleaned in order to form a slurry comprising liquid and solids. The slurry is then transferred to a cleaning and separating apparatus, where it is separated into liquid and solid components. The solids can be disposed of, while the liquids can be reclaimed.

7 Claims, 2 Drawing Sheets

LIMITED SPACE SEPARATION AND CLEANING SYSTEM AND METHOD

CROSS REFERENCES TO RELATED APPLICATIONS

This application claims the benefit of U.S. provisional patent application Ser. No. 61/354,282, filed Jun. 14, 2010, which is incorporated herein by reference for all purposes.

FEDERALLY SPONSORED RESEARCH

Not Applicable

BACKGROUND OF INVENTION

1. Field of Invention

The present invention pertains to a method and apparatus for cleaning tanks and other containers including, but not necessarily limited to, storage tanks used in connection with oil and/or gas operations. More particularly, the present invention pertains to a method and apparatus for cleaning the interior surfaces of tanks, refinery vessels, production vessels, containers and other enclosures, especially in applications where limited space is available.

2. Description of Related Art

Tanks, containers and other similar enclosures are commonly used to store liquids and other fluids in many different industrial, oil and gas, and other applications. Tanks and production vessels of varying sizes and shapes are frequently used to produce and store fluids in connection with the oil and gas industry. By way of example, crude oil produced from wells is typically piped from such wells through production facilities into one or more storage tanks located in general proximity to such wells. Such collected crude oil is thereafter often transported to larger storage tanks at oil refineries or other facilities prior to processing.

When crude oil is stored in a storage tank or production vessel for any length of time, solids and heavier liquid components in such crude oil tend to settle to the bottom of such storage tank or production vessel in the form of sludge. Sludge build up at the bottom of a storage tank or production vessel is undesirable for a number of reasons, the most apparent of which is reduction of the storage capacity of the tank or production vessel.

Additionally, other fluids used in connection with oil and gas operations are also stored in storage tanks. One such fluid that is commonly stored in tanks is drilling mud. Such drilling mud frequently contains chemicals and/or other additives designed to adjust or control certain characteristics of said mud including, without limitation, gelling agents (e.g., colloidal solids and/or emulsified liquids), weighting materials (e.g., barite and/or bentonite, etc.), and/or other chemicals which are used to maintain fluid properties within desired parameters. Further, although drilling fluids have historically been water-based, oil-based and synthetic drilling fluids are commonly used, especially in severe drilling environments. Many drilling mud additives, as well as oil based and synthetic based drilling fluids, can be harmful to personnel and the environment. When drilling muds or other fluids are stored in tanks, solids often fall out of suspension, forming hardened layers at or near the bottom of such tanks. Cleaning of such tanks can be especially challenging when a layer of solids is present. Such solids cannot be simply drained from the tanks/containers; such deposited solids must typically be removed before interior surfaces of the enclosures can be cleaned.

In many cases, personnel are frequently required to physically climb inside storage tanks or production vessel in order to perform manual cleaning operations. Such personnel typically use water hoses, brushes and the like to clean the internal surfaces of such tanks and/or other containers. When sludge or hardened solids are present, such personnel are also often required to manually remove the sludge or deposits from the tanks using shovels or other similar means.

Manual cleaning of storage tanks or production vessels can be very physically demanding on personnel, especially when temperatures inside such tanks are elevated. Moreover, ventilation within such tanks and/or other containers can be very poor, and personnel inside such tanks/containers are frequently exposed to toxins and/or contaminants (typically from solids and/or fluid residue present in such tanks). As a result, manual cleaning of tanks raises safety concerns for personnel performing such cleaning operations.

Regardless of the cleaning methods used, virtually all prior art means of cleaning tanks, or production vessel and/or other containers utilize wash water or some other fluid(s). Such water or other fluid is used to wash sludge, drilling fluid residue, solids and/or other debris from the inner surfaces of such enclosures. After being sprayed, the effluent wash water or other fluid typically contains significant amounts of solids or other contaminants. As a result, such effluent fluid frequently cannot be dumped or otherwise disposed of where the tank, or production vessel or other container is located due to applicable laws, rules or other regulations.

In most cases, in order to avoid environmental contamination and comply with applicable governmental mandates, such effluent fluid and accompanying solids frequently must be collected and transported to another location for off-site disposal. In order to accomplish such off-site disposal, the used wash fluid (and any accompanying solids) typically must be loaded into boxes or other storage containers for transportation away from a tank location. In most cases, large numbers of storage boxes or other portable containers must be rented or purchased in order to hold and transport such waste to off-site disposal facilities, thereby increasing overall project costs. Such storage boxes or other portable containers also take up significant space, which is at a premium on most production facilities, refineries, rigs and other similar facilities (particularly those located in a marine environment).

By separating liquids from solids in the used waste fluid, such liquids can be reclaimed, while separated (substantially "dry") solids can be loaded into storage boxes or other portable containers for transportation and eventual disposal. Because separated solids take up less volume than a mixture of fluids and solids, separation has the effect of reducing the overall number of storage boxes or containers required to store and transport the waste to an off-site disposal facility. Such separation thereby reduces costs and space requirements associated with such storage boxes and the disposal process.

Additionally, separated liquids often contain water and other non-aqueous liquids including, without limitation, oil or other hydrocarbons. It is frequently beneficial to further separate such liquids to remove any such oil or other hydrocarbons. In many cases, such separated oil or other hydrocarbons can have value and can be re-used or sold for a profit.

Accordingly, there is a need for an efficient and effective means for cleaning tanks, or production vessel and/or similar containers, including oil storage tanks containing crude oil sludge, solids-laden fluids and/or hardened solid deposits that have dropped from suspension. The cleaning system should minimize the need for personnel to physically enter such tanks or other containers, and should permit separation of solids from liquids to permit efficient and economical disposal of such solids. Additionally, the cleaning system should be beneficially compact, and should further permit separation of oil and/or other hydrocarbons from wash liquids.

SUMMARY OF THE INVENTION

The present invention comprises a system that can be used to remove solids, water, and oil from storage tanks and or production vessels including, without limitation, oil and gas storage production tanks and vessels located on offshore platforms or land facilities. An advantage of the present invention is that it provides a system with a limited footprint that enables the removal and separation of liquids and solids from a tank without requiring personnel to enter such tanks.

In the preferred embodiment, the components of the present invention fit within a limited space, preferably an 8 foot tall by 8 foot wide by 10 foot deep shipping container. Further, in the preferred embodiment, the components of the present invention preferably comprise a heated working tank having a mechanical/pneumatic agitator and a heating element, a centrifuge feed pump, a separation device (such as, for example, de-sander, de-silter, shale shaker or other similar apparatus) that will separate liquid and solid components, an oil and water effluent tank, an oil and water discharge pump, an auger, a clean water tank, a hot water blaster, and a hot water rotating nozzle.

BRIEF DESCRIPTION OF DRAWINGS

The foregoing summary, as well as the following detailed description of the preferred embodiments, is better understood when read in conjunction with the appended drawings. For the purpose of illustrating the invention, the drawings show certain preferred embodiments. It is understood, however, that the invention is not limited to the specific methods and devices disclosed. Further, dimensions, materials and part names are provided for illustration purposes only and not limitation.

DETAILED DESCRIPTION OF A PREFERRED EMBODIMENT

While the present invention is described herein with reference to preferred embodiments, it will be understood by those skilled in the art that various changes may be made and equivalents may be substituted for elements thereof without departing from the scope of the invention. In addition, many modifications may be made to the present invention without departing from the scope of such invention. In addition, many modifications may be made to adapt a particular situation or material to the teachings of the invention without departing from the essential scope thereof. Therefore, it is intended that the present invention not be limited to the particular embodiments disclosed as the best mode contemplated for carrying out this invention, but that the invention will include all embodiments (and legal equivalents thereof) falling within the scope of this disclosure.

Moreover, it is to be observed that the present invention is described herein primarily in connection with applications associated with tanks, refineries and production facilities designed for the production and storage of produced crude oil and natural gas. However, the description of such application is for convenience, is by way of illustration only, and should not be construed as limiting the scope of the present invention in any way. Notably, the cleaning system of the present invention can be used in connection with many different types and styles of tanks, containers, refineries, production facilities, and/or enclosures, and its utility and advantages should not be seen as being limited exclusively to crude oil storage tanks, or otherwise limited exclusively to either onshore or offshore facilities.

Figure 1:
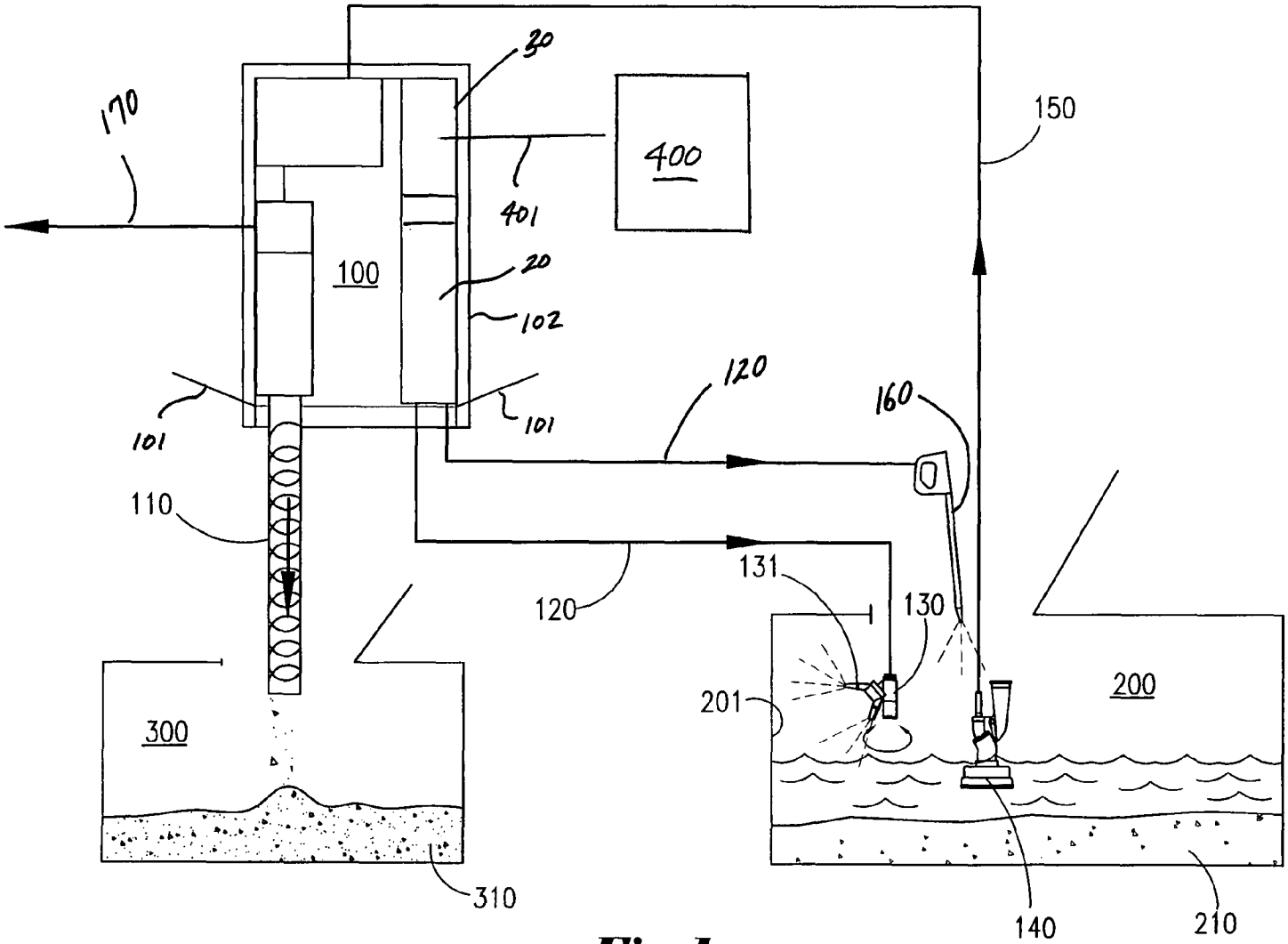
FIG. 1 depicts a systemic layout showing the cleaning system of the present invention being used in connection with a tank.

Referring to the drawings, FIG. 1 depicts a systemic layout of cleaning and separating assembly 100 of the present invention being used in connection with the cleaning of vessel 200. In the preferred embodiment, all of the components of cleaning and separating assembly 100 of the present invention can beneficially fit within a limited space, preferably a shipping container or skid mounted unit. For example, as depicted in FIG. 1, primary components of cleaning and separating assembly 100 of the present invention can be physically housed within shipping container 102 having dimensions of approximately 8 foot tall by 8 foot wide by 10 foot deep/long. Doors 101 can be closed to prevent access to the interior space of said shipping container 102 during transportation or periods of non-use, and opened during periods when such access is required or desirable (such as when the present invention is being used).

Regardless of the exact dimensions, cleaning and separating assembly 100 of the present invention is compact, and requires relatively little space, such that it can be beneficially used on platforms, rigs, refineries or at other onshore or offshore facilities where available space is at a premium. Moreover, cleaning and separating system 100 of the present invention beneficially enables the removal and separation of liquids and solids from a tank or other container (such as vessel 200) without requiring personnel to physically enter such tank for extended periods of time.

Still referring to FIG. 1, fresh water source 400 supplies fresh water to cleaning and separating assembly 100 of the present invention via conduit 401. In the preferred embodiment of the present invention, such wash fluid comprises clean fresh water supplied from fresh water source 400 and stored within a storage tank 30 before such water is transferred to at least one supply tank 20; however, it is to be observed that fluid(s) other than water having suitable properties and characteristics can be used for this purpose without departing from the scope of the present invention.

Such fresh water is generally pumped from said at least one supply tank 20 of cleaning and separating assembly 100 to vessel 200 via conduit(s) 120. As depicted in FIG. 1, vessel 200 represents a crude oil storage tank or other similar container having a layer of solids 210 (such as sludge or other solid materials) deposited on the bottom of said vessel 200.

Such fresh water is pumped from at least one water supply tank 20 via conduit(s) 120 to a high-pressure sprayer (such as pressure washer 160) or a spray nozzle (such as rotating-nozzle sprayer 130), or both, which are disposed within vessel 200. Regardless of the precise configuration, which is often dictated by the conditions to be encountered within said vessel 200, said high-pressure sprayer can beneficially comprise a conventional pressure washer 160, rotating nozzle-sprayer 130, or other device that permits concentrated spraying of liquids at elevated pressures. As depicted in FIG. 1, rotating nozzle sprayer 130 has a plurality of rotating polished nozzles 131 that can be used to direct liquids, such as fresh water or other beneficial wash liquid, toward internal surfaces 201 of vessel 200. Pressure washer 160 (ideally equipped with angled high-pressure jetting nozzles) and rotating nozzle sprayer 130 (ideally equipped with multiple rotating polishing nozzles 131) can be used together or separately to thoroughly clean internal surfaces 201 of vessel 200 by spraying fresh water to clean oil, water, and solids from said internal surfaces 201 of vessel 200.

Such fresh water or other wash fluid sprayed by pressure washer 160 and/or rotating nozzle sprayer 130 can be beneficially pre-heated in order to help break-up oil, water, and solids, and form a heated slurry inside vessel 200 being cleaned. Said heated slurry is pumped from the interior of vessel 200 using pump 140, and transferred back to cleaning and separating assembly 100 via conduit 150 for further handling as discussed in detail below. Pump 140 can comprise a submersible pump, diaphragm pump or other pump that will accomplish the efficient and effective transfer of said heated slurry.

Following receipt of such heated slurry, cleaning and separating assembly 100 of the present invention permits separation of liquids and solids from said heated slurry as set forth in more detail below. Generally, solids 310 recovered from cleaning and separating assembly 200 are transported by solid displacement device (such as auger mechanism 110 depicted in FIG. 1) into a collection container (such as storage and transportation box 300) for storage and eventual transportation to an off-site disposal facility or other location. Separated liquids are transported via outside discharge conduit 170 for further handling as set forth in detail below.

Figure 2:
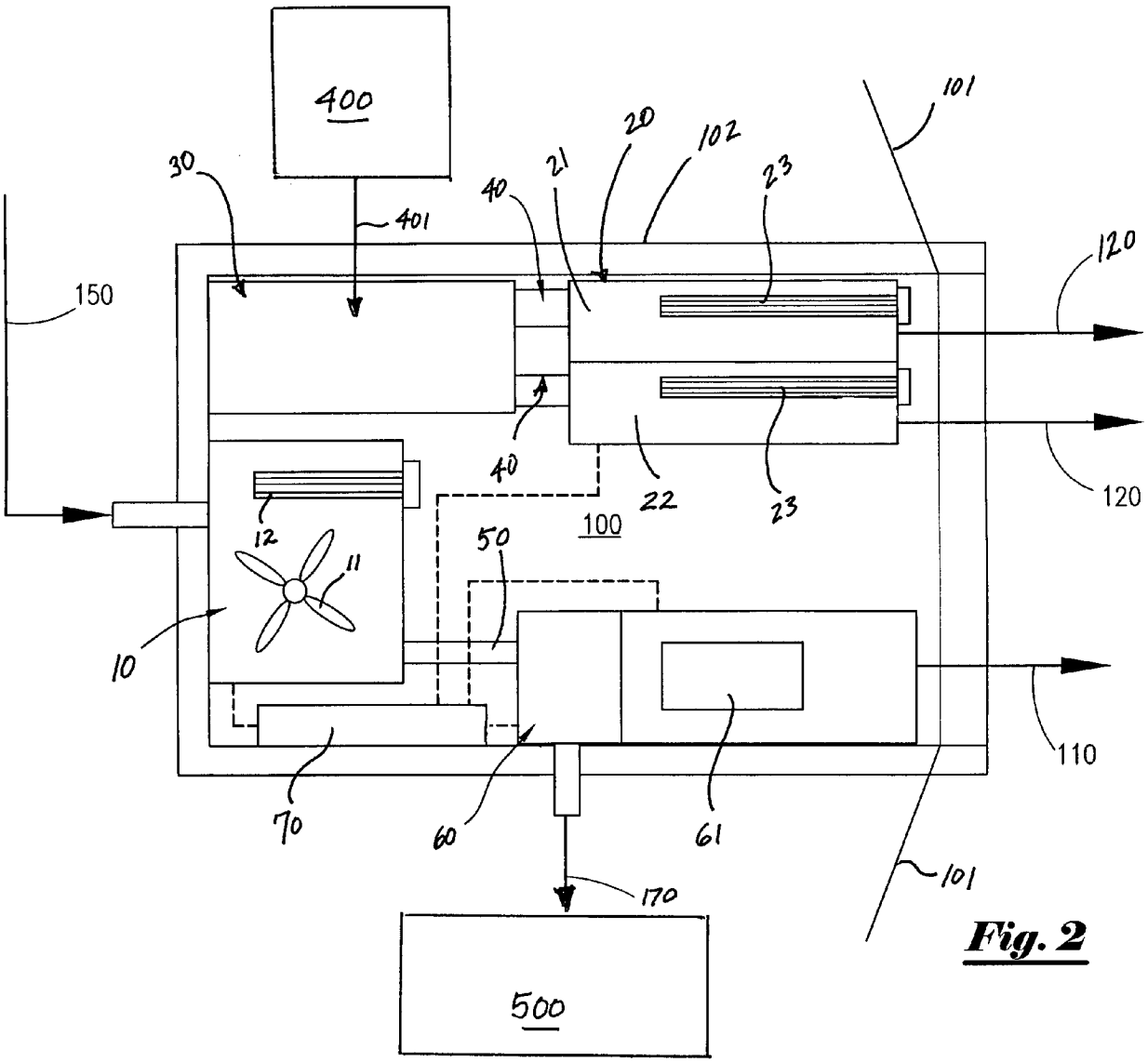
FIG. 2 depicts a process system schematic for the cleaning system of the present invention.

FIG. 2 depicts a process system schematic of cleaning and separating assembly 100 of the present invention. As depicted in FIG. 2, the components of the present invention are preferably contained within an enclosure such as shipping container 102 having doors 101 that can be closed during transportation or periods of non-use, and opened to provide access to the internal space of said shipping container 102, such as when the present invention is being used.

Fresh water is supplied to cleaning and separating apparatus 100 by fresh water source 400. In the preferred embodiment of the present invention, such wash fluid comprises fresh water supplied from fresh water source 400 and stored within at least one clean water storage tank 30. Water in said at least one clean water storage tank 30 is then pumped via at least one pump 40 to at least one supply tank 20. It is to be observed that fluid(s) other than fresh water having suitable properties and characteristics can be used for this purpose without departing from the scope of the present invention.

Fresh water in said at least one supply tank 20 is thereafter pumped from said at least one supply tank 20 to a high-pressure sprayer (such as pressure washer 160 not depicted in FIG. 2) or a spray nozzle (such as rotating-nozzle sprayer 130 not depicted in FIG. 2), or both, via conduits 120. In the preferred embodiment, said at least one supply tank 20 comprises compartments 21 and 22; liquid in compartment 21 supplies pressure washer 160, while liquid in compartment 22 supplies rotating nozzle sprayer 130. As described in detail above, rotating nozzle sprayer 130 and pressure washer 160 are used to direct fresh water (or other beneficial wash liquid) toward internal surfaces 201 of vessel 200 (not depicted in FIG. 2). Such fresh water or other wash fluid stored within compartments 21 and 22 of said at least one supply tank 20 can be beneficially pre-heated using heating elements 23. When heated, such fresh water or other wash fluid is frequently more effective at cleaning internal surfaces of tanks, such as internal surfaces 201 of vessel 200.

After being sprayed, such fresh water or other wash fluid forms a heated slurry inside a tank or other container being cleaned. Said heated slurry is pumped from the interior of a container being cleaned (such as vessel 200 using pump 140 depicted in FIG. 1), and transferred back to cleaning and separating assembly 100 via return conduit 150. Specifically, said heated slurry recovered via return conduit 150 is transferred into heated working tank 10. Said heated working tank 10 can have a mechanical or pneumatic agitator 11 positioned inside said heated working tank 10 to agitate the slurry contained in said tank 10 and keep recovered solids suspended within such slurry. Additionally, heating element 12 can be used to keep said slurry at a desired elevated temperature in order to break-up any emulsion of oil-saturated solids present within said heated working tank 10.

At least one pump, such as centrifugal pump 50, can transfer heated slurry with suspended solids from heated working tank 10 to separation device 60. In the preferred embodiment, said separation device 60 comprises a two-phase separator that can separate liquids from solids. Although many different separation devices can be utilized for this purpose, such separation device 60 can beneficially comprise a de-sander, de-silter, centrifuge, shale shaker, hydro-cyclone or other similar device, or combination thereof, that can be used to separate liquid and solid components of said heated slurry. Such separation devices are well known to those having skill in the art. By way of example, but not limitation, such separation devices can include shale shakers and/or mud separation equipment marketed by TriFlo International, Inc.™ In the preferred embodiment, separation device 60 comprises a high-speed, two-phase horizontal decanter centrifuge 61.

Separated liquids from said separation centrifuge 61 can be transferred via outside discharge line 170 into an external liquid effluent holding tank 500. In many cases, such liquids are maintained in said external effluent tank 500 until cleaning operations are completed, at which point said stored liquids can be pumped or otherwise transferred from said effluent tank 500 back into a container, tank or vessel being cleaned (such as, for example, vessel 200 depicted in FIG. 1).

Alternatively, if desired, an additional separation step can be provided to separate oil from water (or other liquids). In such cases, following said additional separation step, a liquid discharge pump can pump water back into the active wash system, while an oil pump can pump oil back to an oil flow line or other hydrocarbon storage facility.

Solids 310 recovered from said separation device are transported by solids displacement device (such as auger mechanism 110) into a collection container (such as storage and transportation box 300 in FIG. 1) for storage and eventual transportation to an off-site disposal facility or other location.

In the preferred embodiment of the present invention, at least one electrical control panel 70 is provided within container 102 for controlling the different components of the cleaning and separating apparatus 100 of the present invention including, without limitation, pump(s), heating element(s), agitator(s), pressure washer(s) 160 and spray nozzle 130. Additionally, it is to be observed that a microprocessor can be configured with said electrical control panel to automate control of said components of the present invention. Further, it is also to be observed that additional pumps other than those specifically enumerated may be beneficially added to the present invention in order to facilitate efficient and effective transfer of liquids in connection with the process described herein.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention. The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A method for cleaning a hydrocarbon production vessel, separating fluids and reintroducing separated fluids into said vessel comprising:

a. cleaning said vessel, wherein said cleaning comprises:

i) spraying wash fluid into said vessel to form a slurry comprising liquid and solids;

ii) pumping said slurry to a cleaning and separating apparatus wherein said cleaning and separating apparatus further comprises:

aa) a wash fluid supply connected to a pressurized sprayer;

bb) a submersible pump disposed within said vessel;

cc) a slurry tank;

dd) a conduit connecting said submersible pump to said slurry tank;

ee) a two-phase separation device; and ff) a conduit connecting said slurry tank to said two-phase separation device;

b. separating said slurry into liquid and solids, wherein said liquids contain at least one hydrocarbon;

c. disposing of said solids;

d. transferring said separated liquids to a holding tank; and e. reintroducing said separated liquids from said holding tank into said vessel after said step of cleaning said vessel has ceased.

2. The method of claim 1, wherein said slurry tank and two-phase separator are enclosed within a shipping container.

3. The method of claim 2, wherein the dimensions of said shipping container do not exceed ten feet in length by eight feet in width.

4. The method of claim 1, wherein said wash fluid sprayed into said vessel is heated.

5. The method of claim 1, wherein said slurry tank further comprises:

a. a heating element; and b. a fluid agitator.

6. The method of claim 1, wherein said two-phase separation device comprises at least one of the following group: de-sander, de-silter, centrifuge, shale shaker or hydro-cyclone.

7. The method of claim 1, wherein said step of disposing of said solids further comprises:

a. loading said solids into at least one container; and b. transporting said at least one container to a solids disposal facility.

* * * * *